United States Patent [19]

Kvasnes

[11] 4,158,933

[45] Jun. 26, 1979

[54] TURNABLE WINDOW ARRANGEMENTS

[75] Inventor: Harald Kvasnes, Vegsund, Norway

[73] Assignee: Kva-Spil Ltd., Spjelkavik, Norway

[21] Appl. No.: 851,671

[22] Filed: Nov. 15, 1977

[30] Foreign Application Priority Data

Nov. 17, 1976 [NO] Norway ..... 763915

[51] Int. Cl.[2] ..... E05D 15/58

[52] U.S. Cl. ..... 49/260; 49/176

[58] Field of Search ..... 49/260, 161, 157, 176, 49/254

[56] References Cited

U.S. PATENT DOCUMENTS

| | | | |
|---|---|---|---|
| 726,362 | 4/1903 | Shrivell | 49/260 |
| 1,954,797 | 4/1934 | Carl | 49/260 X |
| 3,287,853 | 11/1966 | Silverman | 49/260 X |

*Primary Examiner*—Kenneth Downey

*Attorney, Agent, or Firm*—Kenyon & Kenyon

[57] ABSTRACT

Turnable window arrangement of the kind in which a window sash is capable of being rotated about a horizontal axis through approximately 180° relative to a window frame while the pivotal axis of the sash is moved between upper and lower positions in the frame. A pivot pin is supported horizontally by the sash via a mounting on opposite sides of the upper side portion of the sash. The pivot pin is formed with a head and has a slide portion-supporting lug pivotally mounted thereon. The frame has a first guide groove with which the slide portion is slidably engaged as well as a second guide groove parallel to the first guide groove and receiving the head of the pivot pin. The frame and the sash define a relatively narrow, vertical gap in a direction transversely of the main plane of the window. The lug has a main portion freely pivotable in this gap and made of relatively thin-walled spring steel. The sash is formed with a groove for receiving the mounting supporting the pivot pin.

7 Claims, 4 Drawing Figures

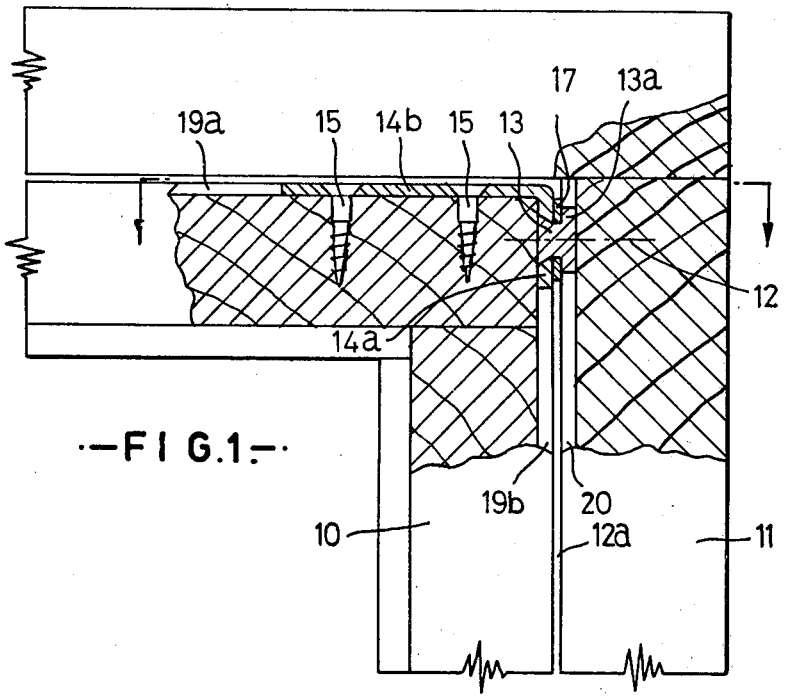
-FIG.1-
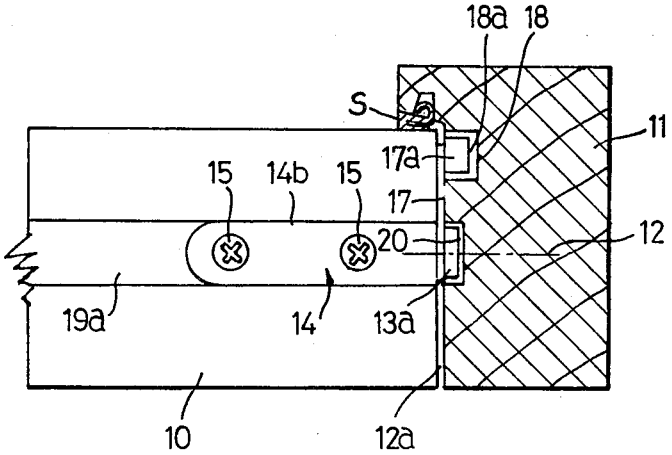
-FIG.2-

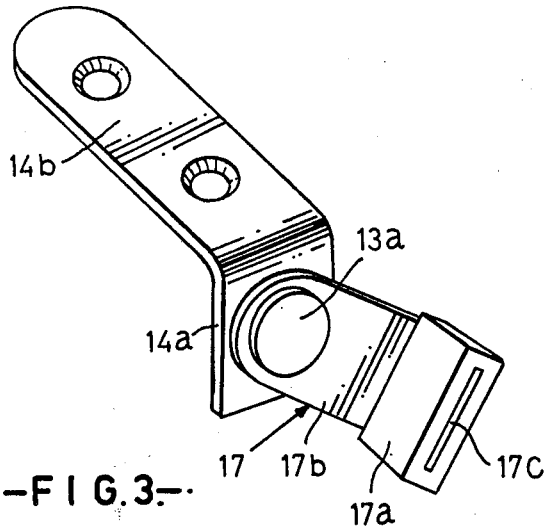
-FIG.3-
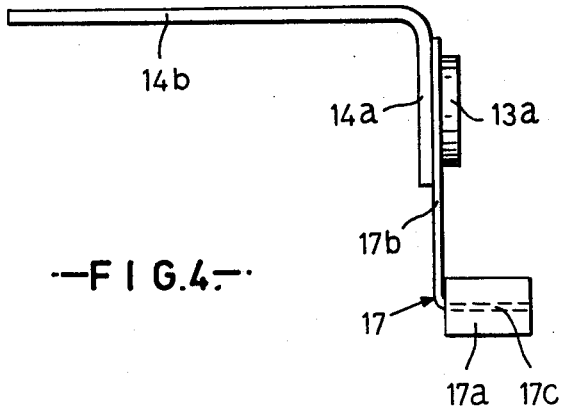
-FIG.4-

TURNABLE WINDOW ARRANGEMENTS

This invention relates to turnable window arrangements of the kind in which a window sash is capable of being rotated about a horizontal axis through approximately 180° relative to a window frame while the pivotal axis of said sash is moved between upper and lower positions in said frame, said sash supporting horizontally by way of a mounting on opposite sides of its upper side portion a pivot pin formed with a head and having a slide portion-supporting lug pivotally mounted thereon, said frame having formed therein a first guide groove with which said slide portion is slidably engaged and defining with said sash a relatively narrow, vertical gap in a direction transversely of the main plane of the window.

Hitherto, it has been usual to make an opening in the windows sash for the reception of portions of the slide portion-supporting lug and the mounting of the pivot pin, in order to be able to permit rotation of the remaining portions of the lug in the narrow gap between the window sash and the window frame. However, significant production problems are involved in making such an opening in the window sash, the opening being effected in the finally produced and finally assembled sash. It is usual to utilise special machines for this particular opening operation. With the present invention the aim is to eliminate such production problems.

Accordingly, the present invention resides in a turnable window arrangement of the kind in which a window sash is capable of being rotated about a horizontal axis through approximately 180° relative to a window frame while the pivotal axis of the sash is moved between upper and lower positions in the frame. The sash horizontally supports by way of a mounting on opposite sides of its upper side, a pivot pin formed with a head and having a slide portion-supporting lug pivotally mounted thereon. The frame has a first guide groove with which the slide portion is slidably engaged and defines with the sash a relatively narrow, vertical gap in a direction transversely of the main plane or the window. The lug has a main portion freely pivotable in the gap. The frame also has a second guide groove parallel to the first guide groove and receives the head of the pivot pin. The sash is also formed with a groove for receiving the mounting supporting the pivot pin.

The invention makes possible the productive technical advantage that the guide grooves for the head of the pivot pin can be milled or made in another way continuously in the same manufacturing operation as one effects the remaining milling operations or manufacturing operations in the profile of the window frame during axial advancement of a window frame stock in its manufacturing apparatus.

In addition, there is achieved the advantage that the guide groove for the head of the pivot pin in the frame lies directly opposite the corresponding groove for the mounting in the sash so that when the window is closed there is obtained, in a manner known per se, an effective vertically extending air vent pocket between frame and sash approximately in the central plane of the window.

In a corresponding manner, the groove for the mounting in the window sash profile can be continuously milled or made in another way during axial advancement of a window sash stock in its manufacturing apparatus.

By means of the aforesaid groove for the mounting in the window sash, there can be formed, if desired, a continuous peripheral groove around the window sash and by means of the guide groove for the head of the pivot pin, if desired, a corresponding continuous peripheral groove in the window frame.

A further advantage is that when in an embodiment in which pivot pin and mounting are of unitary construction and the lug pivotably mounted in an intermediate space therebetween, the mounting is of substantially L-shape with a longest portion of the L-shape engaging the aforesaid groove in the upper horizontal edge surface of the window sash and with a shortest portion of the L-shape engaging the aforesaid groove in the vertical edge surface of the window sash. In this case, a fastening means of the mounting is secured to the window sash via the longest portion of the L-shape.

In this way, an especially torsion-stable mounting can be employed which can be received, without further preparations, directly in the groove in the side portion of the sash and in the upper portion of the sash. Consequently, it is possible to position the pivot pin just outside the outer, upper boundary plane of the sash with effective support in the mounting. Furthermore, it is also possible by means of the L-shaped mounting to fasten the mounting with pivot pin and lug with slide portion as an integral unit to the sash endways from the adjacent room or apartment on assembling on the upper end face of the window sash.

In order that the invention can be more clearly understood, a convenient embodiment thereof will now be described, by way of example, with reference to the accompanying drawings in which:

FIG. 1 is a cut-off view, partly in section, of an upper corner of a window sash and an associated window frame in the arrangement of the invention.

FIG. 2 is a horizontal section on the line 2—2 of FIG. 1, and

FIG. 3 is a perspective view of the mounting with pivot pin and slide portion-supporting lug, and FIG. 4 is a side view of the mounting with pivot pin and lug shown in FIG. 3.

Referring to FIGS. 1 and 2, there is illustrated an upper portion of a wood window sash 10 and a wood window frame 11 of a so-called turnable window, that is to say a window in which the window sash can be rotated about a horizontal axis 12 approximately 180° relative to the window frame at the same time as the pivotal axis of the window sash is moved from the illustrated upper position in the frame in FIG. 1 to a lower position in the frame. In this connection, similar pivot arms, not shown, are employed between sash and frame on opposite sides of a window sash, for example, as is shown in Norwegian Patent Specification No. 122,614. There is employed a narrow, vertical gap **12*a*** of about 3 mm. between sash and frame in order to provide the tightest possible and an, as far as possible, aesthetically attractive joint between frame and sash.

The horizontal pivotal axis 12 passes through two pivot pins 13, that is to say a pivot pin on each side of the window sash, of which only the one pivot pin is shown in FIGS. 1 and 2. The pivot pin 13 is fastened to a mounting 14 which, by means of screws 15, is secured to the sash 10 and in an intermediate space between the mounting 14 and head **13*a* of the pivot pin, there is pivotably mounted a lug 17 having a slide portion 17*a* which is slidably received in a guide groove 18*a*** of a guide rail 18 in the window frame in a manner known per se.

The mounting 14 is received in a groove 19*a*, 19*b* which is milled in the sash, that is to say a groove 19*a* in the upper portion of the sash and a flush groove 19*b* in the vertical portion of the sash. The head 13*a* of the pivot pin 13 is correspondingly displaceable in a groove 20 which is milled in the vertical portion of the frame parallel to the guide groove 18*a* of the slide portion 17*a*. The lug 17 has an L-shaped cross-section as shown in FIGS. 3 and 4 and consists of a main portion 17*b* of relatively thin-walled spring steel and a free-ending leg portion 17*c* which has a slide portion 17*a* of nylon fastened thereon. By designing the grooves 19 and 20 respectively for the mounting and the head of the pivot pin in sash and frame respectively and by employing a lug 17 having a relatively thin-walled main portion, 17*b* it is possible to allow only the main portion 17*b* of the lug to be freely rotatable in the relatively narrow gap 12*a* between sash and frame, without being dependent upon further openings in the sash and frame. From the production point of view, this represents substantial advantages over that which has been normal hitherto in this technical area since the grooves 19 and 20 can be milled in continuous working operations during the manufacture of the sash profile and the frame profile remaining so that additional opening operations are rendered superfluous.

As shown in FIGS. 3 and 4, it is preferred that the mounting is designed with an L-shaped cross-section, having a shortest portion 14*a* of L-shape received in the groove 19*b* in the vertical sash portion and with the longest portion 14*b* of the L-shape received in the groove 19*a* in the horizontal, upper sash portion. The mounting is, as illustrated, secured to the upper, top face of the sash by means of screws 15 secured to the longest portion 14*b* of the L-shape. By means of the L-shaped mounting, there can thus be readily effected assembly and disassembly of the mounting with associated pivot pin and lug with slide portion on the end face of the window sash which can be easily exposed to the room or apartment disposed within. Additionally, there is obtained a particularly torsion-stable mounting which can permit the pivot pin to be fastened to the shortest portion 14*a* of the L-shape exactly up to the longest portion 14*b* of the L-shape, that is to say as far as possible outwardly towards the upper boundary surface of the window sash.

As shown in FIG. 2, a seal S is provided in a peripheral groove in a frame 11 and is secured therein, in any suitable fashion, for example by means of a friction fit or by a suitable adhesive. This seal is of conventional structure and is made, for example of rubber or elastomeric plastic material and forms a lip seal to be compressed by the window sash 10. Such a seal is a conventional structure and need not be further described.

What we claim is:

1. A turnable window arrangement of the kind in which a window sash is capable of being rotated about a horizontal axis through approximately 180° relative to a window frame while the pivotal axis of said sash is moved between upper and lower portions in said frame, said sash having a groove and a mounting secured in said groove on opposite sides of the upper side portion of said sash, a pivot pin extending horizontally from each mounting, each pin having a protruding head, a lug pivotally mounted on each pin with a slide portion at one end of said lug, said frame having formed therein a first guide groove with which said slide portion is slidably engaged and defining with said sash a relatively narrow, vertical gap in a direction transversely of the main plane of the window, said first guide groove extending for the length of vertical movement of said sash, said lug having a main portion of relatively thin-walled spring steel freely pivotable in said gap, said frame having formed therein a second guide groove parallel to and coextensive with said first guide groove and receiving said head of said pivot pin.

2. The arrangement of claim 1, wherein said pivot pin and said mounting constitute an integral member defining therebetween a space in which said lug is pivotably mounted, said mounting being of substantially L-shape having a longest portion engaging a portion of said sash-formed groove in the upper, horizontal edge face of said sash and having a shortest portion engaging a portion of said sash-formed groove in the vertical edge face of said sash, and fastening means for said mounting secured to said sash via said longest portion of said L-shape.

3. A turnable window construction comprising a window frame having at least one vertical portion, a first groove extending along said vertical portion and a second groove extending along said vertical portion parallel to said first groove;

a window sash disposed within said frame to define at least one narrow vertical gap with said frame, said sash having an upper portion, a third groove along said upper portion, a vertical portion and a fourth groove in said vertical portion;

a mounting secured on said sash within said grooves thereof;

a pivot pin fastened to said mounting and slidably received in said first groove of said frame; and a lug having a thin-walled main portion pivotally mounted on said pin and disposed in said vertical gap, said lug having a slide portion at one end of said main portion slidably received in said second groove of said frame.

4. A turnable window construction as set forth in claim 3 wherein said frame and said sash are made of wood.

5. A turnable window construction as set forth in claim 3 wherein said lug is L-shaped with said main portion pivotally disposed about said pin and with a leg portion receiving said slide portion thereon.

6. A turnable window construction as set forth in claim 5 wherein said slide portion is made of nylon.

7. A turnable window construction as set forth in claim 3 wherein said mounting is of L-shape.

* * * * *